United States Patent [19]

Dickinson

[11] Patent Number: 4,784,294

[45] Date of Patent: Nov. 15, 1988

[54] TOOTHPASTE CONTAINER WITH ATTACHED TOOTHBRUSH SUPPORT

[76] Inventor: Robert Dickinson, 153 E. Palmetto Park East, Boca Raton, Fla. 33432

[21] Appl. No.: 114,495

[22] Filed: Oct. 30, 1987

Related U.S. Application Data

[63] Continuation of Ser. No. 909,602, Sep. 22, 1986, abandoned.

[51] Int. Cl.[4] ..... B65D 35/24

[52] U.S. Cl. ..... 222/93; 403/207; 248/316.1

[58] Field of Search ..... 222/93, 105; 248/110, 248/111, 113, 360, 315, 307.1, 311.2, 310, 230, 316.1, 314; 294/31.2; 403/341, 316, 318, 207, 346, 347

[56] References Cited

U.S. PATENT DOCUMENTS

| | | | |
|---|---|---|---|
| 2,441,892 | 5/1948 | Mattoon | 294/31.2 |
| 3,143,152 | 8/1964 | Knable | 222/93 |
| 4,020,975 | 5/1977 | Stauffer | 222/93 |

*Primary Examiner*—Joseph J. Rolla
*Assistant Examiner*—Kenneth Noland
*Attorney, Agent, or Firm*—Myron Amer

[57] ABSTRACT

For use with an upstanding cylindrical toothpaste container, a toothbrush holder is placed within a ring that is then slipped about the container clamping the holder in place, so that a toothbrush can be supported in the holder in a position conveniently closed to the toothpaste.

1 Claim, 1 Drawing Sheet

20H
20
22
24
26

20
24
22
20G
20F
20B
20A
26B 26A
26
30
30B
30A
30F
30E
30D
30C
32
12
12A
20
22
24
20D
20C
20E
20A
26A
26
26B 30A
30B
30E
30F
30A
30D 12
20H
34
26A
26B
14B
26

10
14A
12
14
22
6
24
30
14B
6
20A
26

36
20
38
30

TOOTHPASTE CONTAINER WITH ATTACHED TOOTHBRUSH SUPPORT

This is a continuation, of application Ser. No. 909,602, filed Sept. 22, 1986, now abandoned.

The present invention relates generally to a convenience article of manufacture, wherein an upstanding metal or rigid plastic toothpaste container has an attached toothbrush holder, so that the toothpaste and toothbrush are conveniently together for use, and more particularly to simple, easy to use components for completing the attachment of the toothbrush holder to the referred to toothpaste container.

In a departure from traditional marketing of toothpaste, as exemplified by an externally squeezable tube, toothpaste is also available in containers having a selected one of a variety of hand-operated "pumps" to dispense the toothpaste therefrom. Underlying the present invention is the recognition that the pump-type container, which is an upstanding article having the "pump" in an upper end and a cylindrical body either of metal or rigid plastic, can advantageously be used to significantly enhance the convenience of the user. That is, the toothbrush can be readily attached to said type of container, so that it is always at hand at the same location as the toothpaste, and the attachment achieved so as to contribute to the sterile condition of the toothbrush, as well as providing other benefits and advantages, as will be more particularly explained subsequently herein.

A toothpaste container with an attached toothbrush support demonstrating objects and advantages of the present invention includes a vertically oriented toothbrush holder having upper and lower means extending transversely thereof adapted to supportingly engage the toothbrush, said toothbrush holder having a horizontally oriented recess therein intermediate the upper and lower means. Serving as a support for the holder is a vertically standing toothpaste container of a cylindrical shape in cross section and of a selected diameter. For completing an attachment of the toothbrush holder to the toothpaste container, use is made of a ring that is a slightly larger diameter than that of the toothpaste container, which ring in use is provided with an operative position disposed in the recess of the toothbrush holder and in encircling relation about the container. As a result, the toothbrush holder is held by the ring in attached relation to the container, and the toothbrush stored in the holder is held out-of-contact with any structure or the like, and thus in a manner which contributes to maintaining the toothbrush in a sterile condition.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein.

Figures 1, 2, 3, 4, 5, 6, 7:
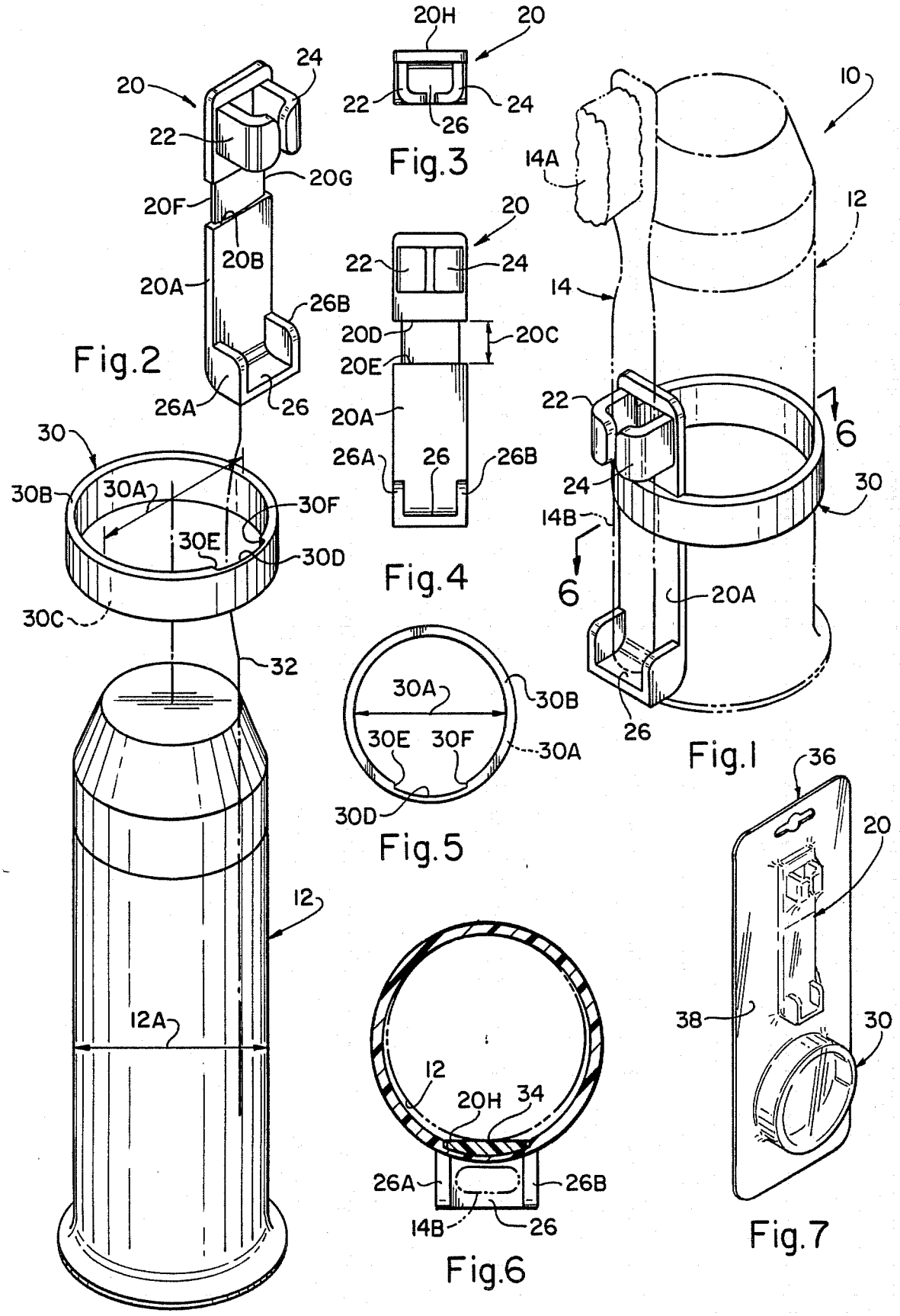
FIG. 1 is a perspective view illustrating the toothbrush holder in its attached condition to the toothpaste container, wherein the toothbrush and container are illustrated in phantom perspective.
FIG. 2 is similarly a perspective view, but illustrating the various components in disassembled condition.
FIG. 3 is a plan view of the toothbrush holder according to the present invention.
FIG. 4 is a front elevational view of said toothbrush holder.
FIG. 5 is a plan view of the ring used for said toothbrush holder.
FIG. 6 is a plan view in cross section taken along lines 6—6 of FIG. 1, showing further structural details.
FIG. 7 is a perspective view illustrating the typical packaging of the toothbrush holder and ring components.

Having reference to FIG. 1 in particular, there is shown therein a toothpaste container with an attached toothbrush support, generally designated 10. In the combination referred to, the toothpaste container, designated 12, will be understood to be of the type that is fabricated of metal or of an appropriate rigid plastic, is cylindrical in shape and is of a specific selected diameter (designated 12A in FIG. 2). Attached to said container 12, as clearly illustrated in FIG. 1, is a conventional toothbrush 14 having a brush 14A at one end and a plastic grip or handle 14B.

In accordance with the present invention, two components, now to be described, are utilized in achieving attached relation of the toothbrush 14 with the toothpaste container 12. One component, generally designated 20, and more particularly illustrated in FIGS. 3 and 4, is preferrably constructed of plastic by injection molding or other appropriate process and includes a body, herein specifically designated 20A, that in practice is vertically oriented and includes at its upper end a pair of laterally extending arms 22 and 24, each of an arcuate shape as illustrated in FIG. 3, and at the opposite end of said body 20A, there is a U-shaped configuration formed by a bottom wall 26 and opposite side walls 26A and 26B. As is perhaps best illustrated in FIG. 1, when the toothbrush 14 is supported on the toothpaste container 12 using the vertically oriented toothbrush holder 20, the upper arms 22 and 24 are in encircling relation about the toothbrush handle 14B and the bottom of said handle 14B is within the U-shaped configuration and rests on the bottom wall 26.

Reference should now be made in particular to FIGS. 2, 5 and 6, which best illustrate how the toothbrush 20 is assembled to the toothpaste container 12. Formed in the body 20A, just below the laterally extending arms 22 and 24, is a horizontally oriented recess 20B of a selected height 20C. Provided to cooperate in the attaching process with the recess 20B is a ring 30, preferably fabricated of plastic. Ring 30 has an inside diameter 30A which will be understood to be slightly larger than the diameter **12*a* of the toothpaste container 12. As a result, ring 30 has a sliding fit about the cylindrical diameter of the toothpaste container 12. However, and in accordance with the present invention, before the ring 30 is slipped about the container 12, the toothbrush holder 20 is placed inside the ring, as illustrated by the reference line 32, and the ring 30 seated in the recess 20B. That is, the opposite walls 20D and 20E which bound the recess 20B are located on opposite sides of the sides 30B and 30C of the ring 30, and in this manner therefore the ring 30 limits sliding movement of the toothbrush holder 20 within the ring 30. In addition, wall 20E of the recess 20B engages the side 30D of ring 30, and thus supports the toothbrush holder 20** in its vertically oriented position.

In the illustrated embodiment, a vertically oriented slot 30D is provided in the inside surface of the ring 30 and is aligned with the horizontally oriented recess 20B of the holder 20. As a result, the walls 30E and F of the slot 30D are located on opposite sides of the sides 20F and 20G of the toothbrush body 20A that is in the vicinity of the recess 20B. Thus, the walls 30E and 30F function as stops against the sides 20F and 20G and thus limit the circumferential movement of the holder 20 in its vertically oriented position within the ring 30. It also should be noted that there is some frictional resistance between the holder rear wall 20H and the external surface of the toothpaste container 12, as at 34, which minimizes inadvertent circular movement in the toothbrush holder 20 about the vertical axis, and thus along the external surface of the container 12.

Since it is contemplated that the holder 20 and the ring 30 might be supplied separately from the container 12, for completeness sake, and as is illustrated in FIG. 7, it is noted that these components can be conveniently provided on a product card 36 under a heat shrunk plastic cover 38.

From the foregoing, it should be readily appreciated that there has been described herein an easily and readily assembled cooperating pair of components 20 and 30 which when attached to an upstanding toothpaste container 12 result in a convenience article of manufacture 10 that locates a toothbrush 14 in close proximity to a source of toothpaste. Additionally, the vertical orientation of the container 12 is used to advantage in holding in a corresponding vertical orientation the toothbrush 14 so that the brush 14A thereof is maintained out of contact with any structures in the environment, which, of course, contributes to maintaining the brush 14A in a sterile condition.

A latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

What is claimed is:

1. A paste-dispensing container with an attached implement support comprising a vertically oriented implement holder having upper and lower means extending transversely thereof to supportingly engage an elongated implement having a brush-like portion at an end thereof whereby the brush-like portion is free of contact with said holder, said implement holder having a horizontally oriented recess therein intermediate said upper and lower means, a vertically standing paste-dispensing container of a cylindrical shape in cross section and of a selected diameter, and a ring for attaching said implement holder to said paste-dispensing container having a vertically oriented recess on an inner surface thereof to receive therein said implement holder, said ring being of fixed, slightly larger diameter diameter than that of said paste-dispensing container so as to be readily placed in encircling relation about such container with a nominal clearance therebetween, said implement holder and said ring prior to being disposed on said container being placed in an assembled relation with each other by having said horizontally oriented recess of said implement holder interengaged with said vertically oriented recess of said ring, said implement holder being in an interposed position between said ring and said container effectively taking up said clearance therebetween, and forming a clamping action between said ring and implement holder, whereby said assembly of said ring and implement holder is held by friction against said container.

* * * * *